US010617246B2

(12) United States Patent
Gray

(10) Patent No.: US 10,617,246 B2
(45) Date of Patent: Apr. 14, 2020

(54) CUP HANDLE CONNECTOR

(71) Applicant: Russell Edward Gray, Plant City, FL (US)

(72) Inventor: Russell Edward Gray, Plant City, FL (US)

( * ) Notice: Subject to any disclaimer, the term of this patent is extended or adjusted under 35 U.S.C. 154(b) by 0 days.

(21) Appl. No.: 16/034,562

(22) Filed: Jul. 13, 2018

(65) Prior Publication Data

US 2020/0015613 A1 Jan. 16, 2020

(51) Int. Cl.

| | |
|---|---|
| ***A47J 45/07*** | (2006.01) |
| ***B25G 3/32*** | (2006.01) |
| ***A47G 23/02*** | (2006.01) |

(52) U.S. Cl.

CPC ..... *A47G 23/0216* (2013.01)

(58) Field of Classification Search

CPC ..... Y10T 16/4707; A47G 23/0216; A47G 23/0266

See application file for complete search history.

(56) References Cited

U.S. PATENT DOCUMENTS 3,987,993 A * 10/1976 Hopkins ..... E06C 7/14 248/210
4,256,281 A * 3/1981 Harris ..... B62J 11/00 224/414
4,878,642 A * 11/1989 Kirby, Jr. ..... A47K 1/08 248/311.2
5,325,982 A * 7/1994 Cobb, Jr. ..... A47G 19/2222 215/228
5,356,107 A * 10/1994 Sinohuiz ..... A47C 7/62 248/223.41
5,597,148 A * 1/1997 Gospodarich ..... A47C 7/68 248/230.5
5,671,503 A * 9/1997 Uebelacker ..... A47G 19/2266 16/111.1
6,179,259 B1 * 1/2001 Schioldager ..... B65D 83/40 206/228
6,227,510 B1 * 5/2001 McMullen, Sr. ..... A47C 7/68 248/230.5
6,227,511 B1 * 5/2001 De Costa ..... A47C 7/62 248/311.2
6,942,131 B2 * 9/2005 Trautman ..... B62J 11/00 224/414
7,581,704 B1 * 9/2009 Pugsley ..... A47G 23/0233 220/737
7,686,183 B2 * 3/2010 Ziegler ..... A47G 23/0233 220/212.5
7,874,109 B2 * 1/2011 Stevenson ..... B32B 18/00 52/232
D654,322 S * 2/2012 Duncan ..... E06C 7/14 D7/620
D709,738 S * 7/2014 Weinert ..... A47C 7/62 D7/622

(Continued)

*Primary Examiner* — Chuck Y Mah
(74) *Attorney, Agent, or Firm* — Cygnet IP Law, P.A.; Stephen W. Aycock, II

(57) ABSTRACT

A cup handle connector is described. In some examples, the cup handle connector can include a sleeve portion having a surface that substantially conforms to an exterior profile of a cup and an intermediate portion attached to the sleeve portion. The cup handle connector can also include a handle attachment portion attached to the intermediate portion, with the handle attachment portion constructed to attach a weapon handle.

12 Claims, 8 Drawing Sheets

(56) References Cited

U.S. PATENT DOCUMENTS

| | | | | |
|---|---|---|---|---|
| 9,345,353 | B2 * | 5/2016 | Forbes | G09F 21/04 |
| 2015/0041480 | A1 * | 2/2015 | Ramsey | A47G 23/0266 220/758 |
| 2015/0108152 | A1 * | 4/2015 | Franzen | B65D 25/2817 220/758 |
| 2017/0258253 | A1 * | 9/2017 | Ziegler | A47G 23/0233 |
| 2017/0334606 | A1 * | 11/2017 | Austin | A47G 19/22 |

* cited by examiner

CUP HANDLE CONNECTOR

FIELD

Some implementations relate generally to an apparatus for connecting a cup to a handle, i.e., a cup handle connector apparatus.

BACKGROUND

Cups are commonly used to carry beverages. Some of these cups are insulated to retain hot beverages at high temperatures for a long period of time. Similarly, other cups are insulated to retain cold beverages at low temperatures for a long period of time.

Some cups do not have handles. Such cups are difficult to hold and use. Also, some of the conventional techniques for holding cups are not convenient in certain situations. Examples of such situations include walking, driving, standing for long periods of time, among others.

It may be desirable to provide a connector to connect different kinds of cups to different types of handles to enable convenient use of a cup in varying situations. Some implementations were conceived in light of the above-mentioned needs, limitations, or problems, among other things.

SUMMARY

Some implementations include a cup handle connector. The cup handle connector can include a sleeve portion having a surface that substantially conforms to an exterior profile of a cup and an intermediate portion attached to the sleeve portion. The cup handle connector can also include a handle attachment portion attached to the intermediate portion, with the handle attachment portion constructed to attach a weapon handle.

The exterior profile of the cup can substantially conform to a curvature of a circle or an ellipse. The exterior profile of the cup can also substantially conform to any two-dimensional shape with n sides, where n is an integer greater than 2. For example, the exterior profile of the cup can substantially conform to the shape of a triangle (n=3), a square or a rectangle (n=4), or a pentagon (n=5).

The weapon handle can be attached to the handle attachment portion of the cup handle connector using fasteners such as screws. The weapon handle can also be attached to the handle attachment portion of the cup handle connector using an adhesive or a nut and bolt assembly. The weapon handle can further be attached to the handle attachment portion of the cup handle connector using one or more magnets, an interference fit or a mechanical locking mechanism.

The weapon handle attached to the handle attachment portion of the cup handle connector can be a firearm handle, a gun handle, a rifle handle, a knife handle or a sword handle, among others. The weapon handle can, for example, be the handle of an AR-15 rifle.

The sleeve portion, the intermediate portion and the handle attachment portion can form a single integrated unit without joints, interfaces, connections, or attachments.

Some implementations can include a method of making a cup handle, the method can include forming a sleeve portion having an interior surface that substantially conforms to an exterior profile of a cup. The method can also include forming an intermediate portion attached to the sleeve portion. The method can further include forming a handle attachment portion attached to the intermediate portion, wherein the handle attachment portion is constructed to attach to a weapon handle and, in turn, to connect the weapon handle with the intermediate portion.

DETAILED DESCRIPTION

Figure 1:
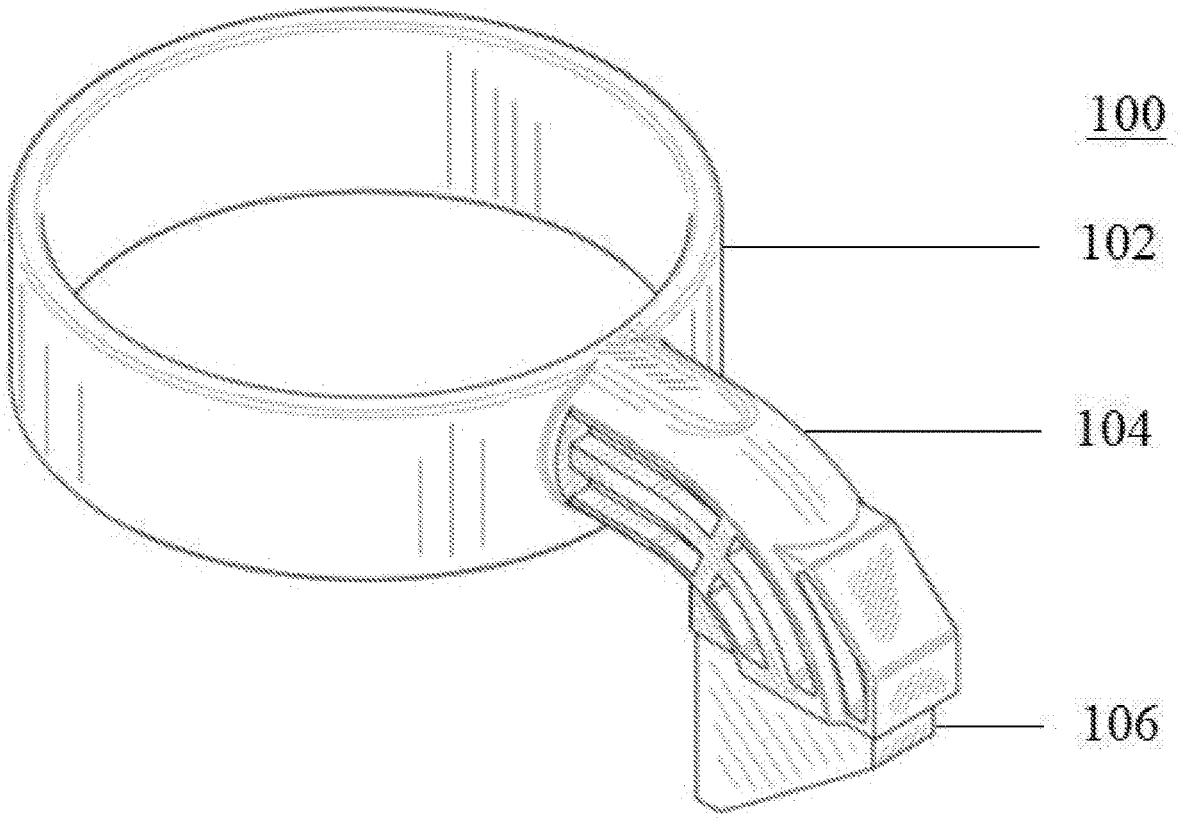
FIG. 1 is a diagram showing a left, top perspective view of an example cup handle connector in accordance with some implementations.
Figure 2:
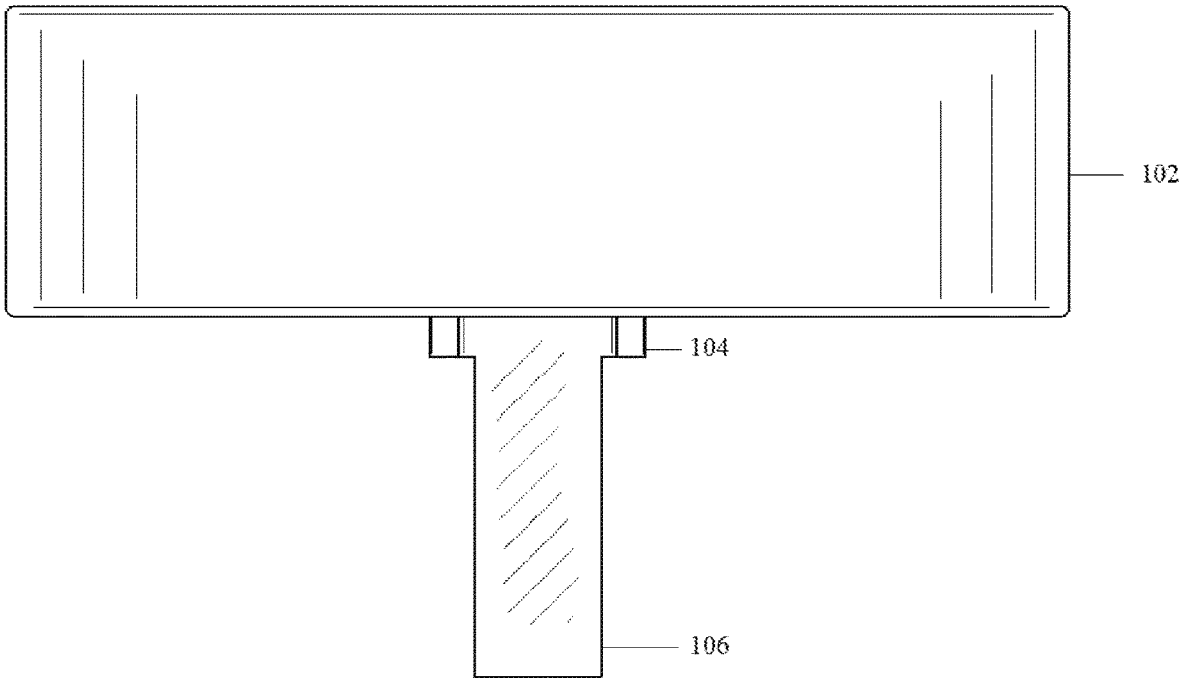
FIG. 2 is a diagram showing a front elevation view of an example cup handle connector in accordance with some implementations.
Figure 3:
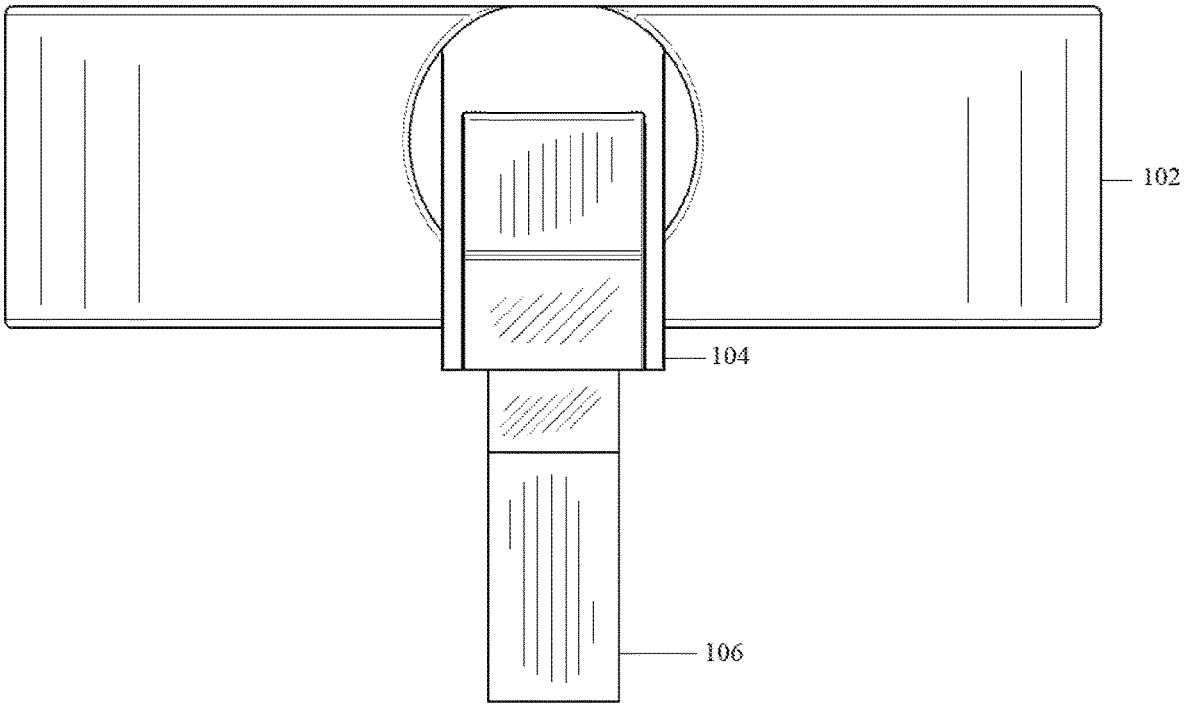
FIG. 3 is a diagram showing a rear elevation view of an example cup handle connector in accordance with some implementations.
Figure 4:
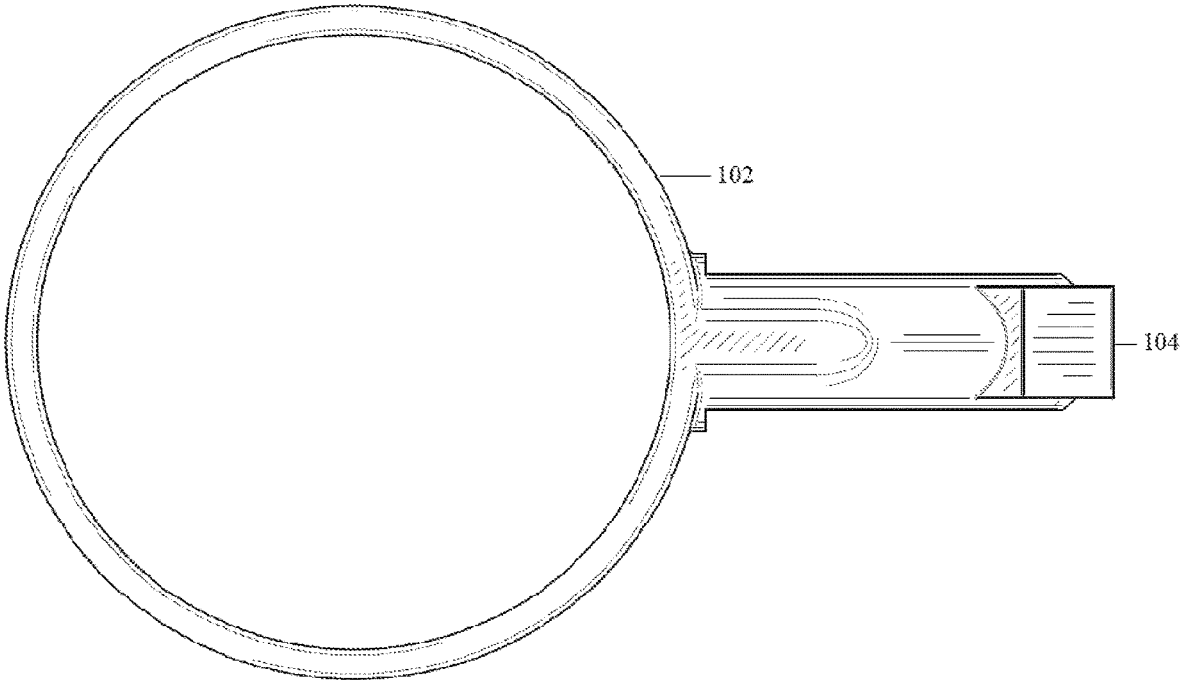
FIG. 4 is a diagram showing a top elevation view of an example cup handle connector in accordance with some implementations.
Figure 5:
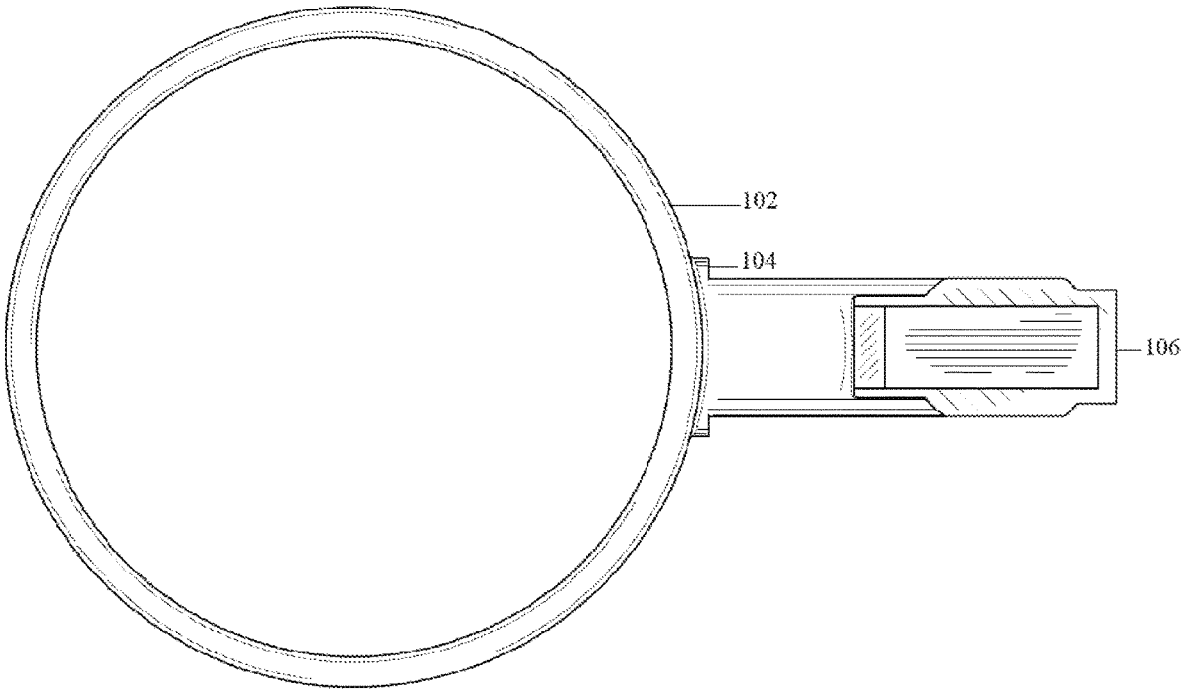
FIG. 5 is a diagram showing a bottom elevation view of an example cup handle connector in accordance with some implementations.
Figure 6:
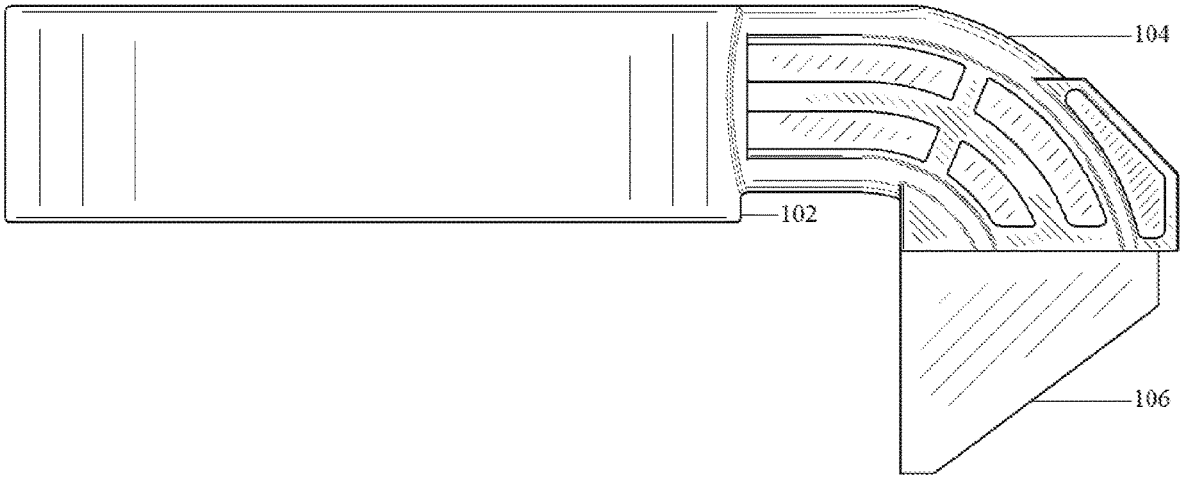
FIG. 6 is a diagram showing a right side elevation view of an example cup handle connector in accordance with some implementations.

FIGS. 1-8 show diagrams of an example cup handle connector (e.g., 100). As shown in FIG. 1, an example cup handle connector 100 includes a sleeve portion 102, an intermediate portion 104 and a handle attachment portion 106.

The sleeve portion 102 has a surface that substantially conforms to an exterior profile of a cup and the intermediate portion 104 is attached to the sleeve portion 102. The handle attachment portion 106 is attached to the intermediate portion 104, with the handle attachment portion 106 constructed to attach a weapon handle. In some implementations, the handle attachment portion 106 is configured to attach the handles of the AR platform of rifles, e.g., an AR-15 rifle handle.

Figure 7:
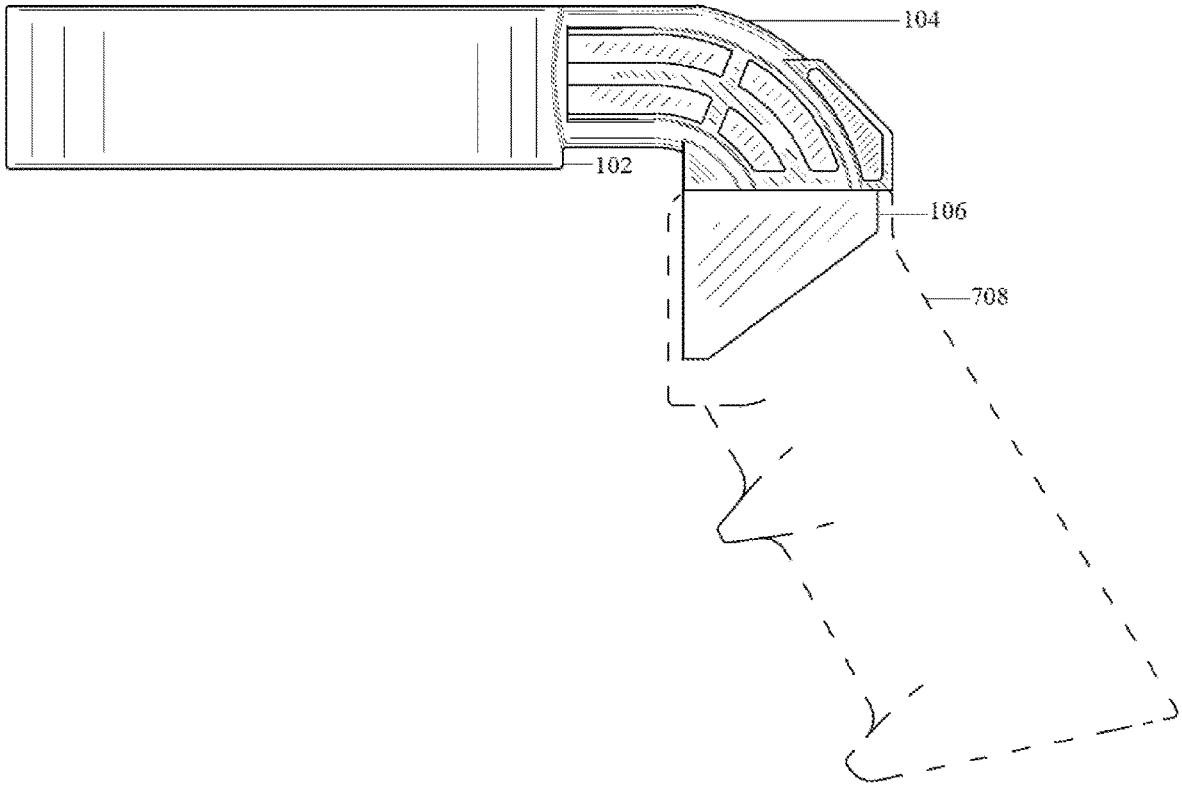
FIG. 7 is a diagram showing a right side elevation view of an example cup handle connector connected to an illustrative weapon handle in accordance with some implementations.

The handle attachment portion 106 is connected to an illustrative weapon handle 708 in FIG. 7. The illustrative weapon handle 708 can be connected to the handle attachment portion 106 using a fastener. For example, the illustrative handle 708 is the handle of an AR-15 rifle and is connected to the handle attachment portion 106 using one or more screws. Also, it will be appreciated that the weapon handle described herein is for illustration purposes only and is not intended to be limiting. Other handles can be used depending on a contemplated implementation. Handles can include replicas of weapon handles as well as actual weapon handles. The handle attachment portion 106 can be configured to attach different weapon handles, e.g., handles of guns, firearms, rifles, knives, and swords, based on their size and shape. Weapon handles can also be attached to the handle attachment portion 106 using mechanical locking mechanisms.

It will be appreciated that the fasteners described herein are for illustration purposes only and are not intended to be limiting. Other fasteners such as adhesives, nuts and bolts, and magnets, among others, could be used depending on a contemplated implementation.

Figure 8:
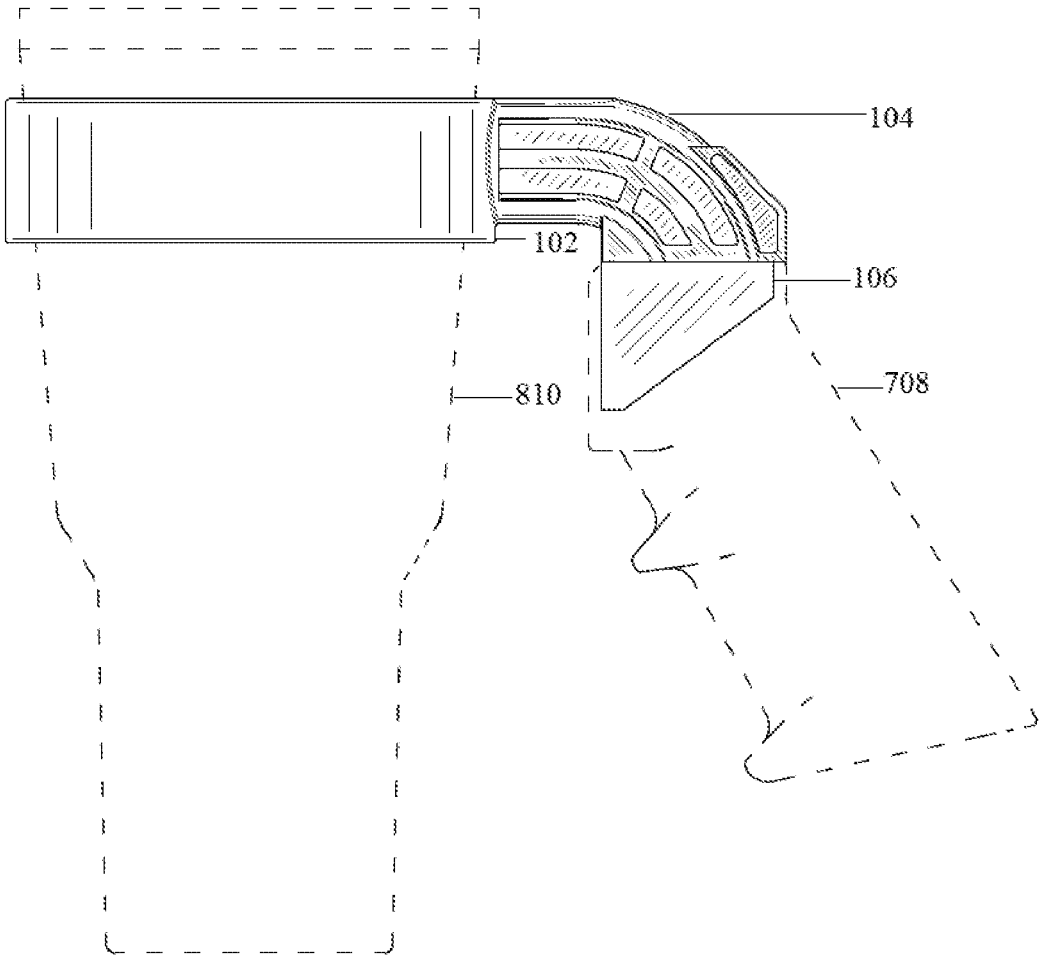
FIG. 8 is a diagram showing a right side elevation view of an example cup handle connector connecting an illustrative weapon handle to an illustrative cup in accordance with some implementations.

The sleeve portion 102 holds an illustrative cup 810 in FIG. 8. It will be appreciated that the cup described herein is for illustration purposes only and is not intended to be limiting. Other cups could be used depending on a contemplated implementation. A cup can also include any container, with or without a lid or cover, depending on a contemplated implementation.

The sleeve portion 102, the intermediate portion 104 and the handle attachment portion 106 can be made of a variety of materials, including, for example, plastic, metal, wood, stone, composite, synthetic, natural and man-made materials.

In some implementations, the dimensions of an example handle attachment portion are around 31.75 millimeters ("mm") in length, 9.5 mm in width and 24 mm in height. In some implementations, the handle attachment portion attaches the weapon handle using one or more screws. In one such implementation, a ¼-20 machine screw is used to attach the weapon handle to the handle attachment portion. The hole in the handle attachment portion to receive the screw in this implementation is 17.82 mm in circumference and is pre-threaded for the ¼-20 screw. It will be appreciated that any dimensions described herein are for illustration purposes only and are not intended to be limiting. Other dimensions could be used depending on a contemplated implementation.

It is therefore apparent that there is provided, in accordance with the various example implementations disclosed herein, a cup handle connector.

While the disclosed subject matter has been described in conjunction with a number of implementations, it is evident that many alternatives, modifications and variations would be or are apparent to those of ordinary skill in the applicable arts. Accordingly, Applicant intends to embrace all such alternatives, modifications, equivalents and variations that are within the spirit and scope of the disclosed subject matter.

What is claimed is:

1. A cup handle connector comprising:

a sleeve portion having an interior surface that substantially conforms to an exterior profile of a cup;

an intermediate portion attached to the sleeve portion; and a handle attachment portion attached to the intermediate portion, wherein the handle attachment portion is constructed to attach to a handle and, in turn, to connect the handle with the intermediate portion, and wherein the handle is attached to the handle attachment portion using one of one or more fasteners, one or more screws, one or more magnets, an interference fit, a mechanical locking mechanism, a nut and bolt assembly or an adhesive.

2. The cup handle connector of claim 1, wherein the exterior profile substantially conforms to a curvature of at least one of a circle or an ellipse.

3. The cup handle connector of claim 1, wherein the exterior profile substantially conforms to a two-dimensional shape with n sides, where n is an integer greater than 2.

4. The cup handle connector of claim 1, wherein the handle is a rifle handle.

5. The cup handle connector of claim 4, wherein the rifle handle is an AR-15 rifle handle.

6. The cup handle connector of claim 1, wherein the sleeve portion, the intermediate portion and the handle attachment portion form a single integrated unit without one or more joints, interfaces, connections, or attachments.

7. A cup handle connector comprising:

a sleeve portion having an interior surface that substantially conforms to an exterior profile of a cup;

an intermediate portion attached to the sleeve portion; and a handle attachment portion attached to the intermediate portion, wherein the handle attachment portion is constructed to attach to a handle and, in turn, to connect the handle with the intermediate portion, wherein the handle is attached to the handle attachment portion using one or more fasteners, and wherein the handle is at least one of a firearm handle, a gun handle, a rifle handle, a knife handle or a sword handle.

8. The cup handle connector of claim 7, wherein the rifle handle is an AR-15 rifle handle.

9. The cup handle connector of claim 7, wherein the sleeve portion, the intermediate portion and the handle attachment portion form a single integrated unit without one or more joints, interfaces, connections, or attachments.

10. The cup handle connector of claim 9, wherein the rifle handle is an AR-15 rifle handle.

11. A cup handle connector comprising:

a sleeve portion having an interior surface that substantially conforms to an exterior profile of a cup;

an intermediate portion attached to the sleeve portion; and a handle attachment portion attached to the intermediate portion, wherein the handle attachment portion is constructed to attach to a handle and, in turn, to connect the handle with the intermediate portion, wherein the handle is attached to the handle attachment portion using one or more screws, and wherein the handle is at least one of a firearm handle, a gun handle, a rifle handle, a knife handle or a sword handle.

12. The cup handle connector of claim 11, wherein the sleeve portion, the intermediate portion and the handle attachment portion form a single integrated unit without one or more joints, interfaces, connections, or attachments.

* * * * *